United States Patent [19]

Janvrin

[11] Patent Number: 4,664,017

[45] Date of Patent: May 12, 1987

[54] HYDRAULIC CONTROL SYSTEM AND VALVE

[75] Inventor: Robert B. Janvrin, Climax, Mich.

[73] Assignee: General Signal Corporation, Stamford, Conn.

[21] Appl. No.: 590,829

[22] Filed: Mar. 19, 1984

[51] Int. Cl.[4] ..... F15B 11/22; F15B 13/06

[52] U.S. Cl. ..... 91/420; 91/448; 137/523

[58] Field of Search ..... 91/420, 447, 448; 137/522, 523

[56] References Cited

U.S. PATENT DOCUMENTS

| | | | |
|---|---|---|---|
| 2,074,268 | 3/1937 | Lowe | 137/53 |
| 2,389,654 | 6/1942 | Van Der Werff | 60/54.6 |
| 2,890,715 | 6/1959 | Ebersold . | |
| 3,410,427 | 12/1965 | McCarthy | 214/83.3 |
| 4,089,344 | 5/1978 | Flaschar et al. | 137/491 |
| 4,176,679 | 12/1979 | Roger | 137/495 |
| 4,180,365 | 12/1979 | Herpich et al. | 414/525 |
| 4,228,818 | 10/1980 | Nelson | 137/115 |
| 4,300,591 | 11/1981 | Sutton | 137/493.4 |

FOREIGN PATENT DOCUMENTS

| | | |
|---|---|---|
| 2225640 | 11/1974 | France . |
| 1446051 | 8/1976 | United Kingdom . |
| 1468184 | 3/1977 | United Kingdom . |

*Primary Examiner*—Abraham Hershkovitz
*Assistant Examiner*—Mark A. Williamson
*Attorney, Agent, or Firm*—Harold Huberfeld

[57] ABSTRACT

An improved sequence-and-relief valve comprises a housing (60), a plurality of conduits (42/44, 46, 53) opening into a bore (62) within the housing, a valve cartridge (64) with the bore, the valve cartridge having a central bore (66) in which a valve element (76) may be moved into and out of contact with seat (74) to control flow from a cylinder port (70) to a tank port (72) in response to changes in pressure acting at pump port (68) or at cylinder port (70). See FIG. 2.

14 Claims, 4 Drawing Figures

HYDRAULIC CONTROL SYSTEM AND VALVE

TECHNICAL FIELD

The invention is concerned in general with hydraulic control systems and valves and in particular with such systems and valves which control the pressure in a fluid motor and relieve this pressure in response to the level of the pressure itself, the level of the delivery pressure of the pump in the system, or both.

BACKGROUND ART

For many years, those skilled in the design of hydraulic systems have recognized that under some circumstances operating cylinders or motors must be protected from over pressurization when the control spool of the associated control valve is in a blocked position which prevents flow from the operating cylinders. Often, a relief valve has been connected to the cylinder port of the control valve to prevent such overpressurization. Frequently, such a relief valve has been incorporated into the control valve itself to provide a more compact and economical package.

In some applications, there are also conditions where mechanical linkages may interact to create overpressurization of one operating cylinder when another operating cylinder is functioning. In these situations, the usable hydraulic force for the other operating cylinder may be reduced and stalling of the system may be experienced due to reduced flow. To overcome this type of difficulty, prior systems have included separate overload relief valves, sequence valves and control valves, all plumbed into such hydraulic systems to reduce or unload the pressure acting at the cylinder port of the one operating cylinder.

One example of prior art hydraulic systems in which mechanical linkages may interact to cause overpressurizing of a motor and stalling of a pump is disclosed in U.S. Pat. No. 3,410,427 granted to McCarthy for a refuse packing system. A refuse truck is provided with a ram or packer panel driven by an hydraulic motor which forces refuse into a storage compartment where it is compressed against an ejector panel driven by another hydraulic motor. As packing of the refuse proceeds, the pressure in the hydraulic motor for the ejector panel rises as the refuse is compacted. Eventually, it becomes necessary to relieve the pressure in the hydraulic motor for the ejector panel so that the panel can move into the refuse storage compartment, thereby allowing the packer panel to force more refuse into the storage compartment and preventing stalling of the system. In such prior art systems, relief of excess pump discharge pressure and excess pressure in the hydraulic motor for the ejector panel has been achieved by plumbing into the hydraulic system, separately from the control valve, a first valve for relieving system pressure at a first predetermined pressure and a second valve for relieving the pressure in the hydraulic motor to the ejector panel at a second, predetermined pressure. In one actual prior art system embodied in a refuse truck, the sensing line for relief of pump discharge pressure was connected upstream of the control valve for the ejector panel motor which caused the valve to release very quickly and resulted in poor compaction. A need has continued to exist for a control valve incorporating additional relief valves responsive to pump discharge pressure, cylinder pressure, or both.

DISCLOSURE OF THE INVENTION

The primary object of the present invention is to provide an improved sequence-and-relief valve and improved sequence-only valve, each incorporated in a cartridge which can be readily included in a conventional open center, three-position control valve.

A further object of the invention is to provide such valves which are simple in structure and easily adjusted to change the relief pressure setting.

The above objects of the invention are given only by way of example. Thus, other desirable objectives and advantages inherently achieved by the disclosed invention may occur or become apparent to those skilled in the art. Nonetheless, the scope of the invention is to be limited only by the appended claims.

An hydraulic system embodying a valve according to the invention comprises a source of hydraulic fluid, a pump connected to the source of delivering a flow of hydraulic fluid, a fluid actuated piston-and-cylinder motor and an open center control valve for directing fluid to and from opposite sides of the piston of the motor to cause the piston to translate within its cylinder and move a load. A first conduit is connected from the pump to the inlet port and through the open center of the control valve and back to the source; a second conduit is connected from one cylinder port of the control valve to one side of the piston; a third conduit is connected from the other cylinder port of the control valve to the other side of the piston; and a fourth conduit is connected from the discharge port of the control valve directly to the source. As used in this specification, the term "conduit" means any means for conveying pressurized hydraulic fluid from one part of the system to another such as a tube, a pipe, an interior passage in a valve or motor, and the like. A sequence-only valve according to the invention is connected downstream of the control valve among the first conduit, one of the second and third conduits and the source, for venting the cylinder on one side of the piston to the source when the pump discharge pressure downstream of the control valve in the first conduit exceeds a first predetermined limit. This sequence-only valve comprises a housing, which may be the same housing as the control valve's, the housing having a first bore therein, the first conduit, one of the second and third conduits and the fourth conduit being connected to this first bore. A tubular valve cartridge is positioned within the first bore, the valve cartridge having a second bore therein, at least one first port leading from the second bore to the first conduit, at least one second port leading from the second bore to one of the second and third conduits and at least one third port leading from the second bore to the fourth conduit. A valve member is mounted to slide within the second bore, the valve member having an axially extending portion of reduced diameter for hydraulically connecting the second and third ports when the pressure in the first conduit exceeds a first predetermined limit. Means such as a spring bias the valve member away from a position in which hydraulic communication is established between the second and third ports. Flow between the second and third ports may be limited by an orifice either upstream or downstream of the portion of reduced diameter. Finally, piston means are mounted to slide within the bore for engaging and moving the valve member when the pressure acting through the first port on the piston means exceeds a predetermined limit, thereby establishing a communication betwen the second and third ports.

In a further embodiment of the invention, a sequence-and-relief valve comprises a tubular valve cartridge positioned within the first bore, the cartridge having a second bore and at least one first port leading from the second bore to the first conduit, at least one second port leading from the second bore to one of the second and third conduits and at least one third port leading from the second bore to the fourth conduit. A valve seat is provided in the second bore between the second and third ports and a valve member is mounted to slide within the second bore. Means such as a spring bias the valve member into contact with the valve seat to close hydraulic communication between the second and third ports until the pressure on the one side of the piston exceeds a second predetermined limit and acts through the second port and cause the valve member to move away from its seat. Flow between the second and third ports may be limited by an orifice positioned either upstream or downstream of the valve seat. Piston means are also mounted to slide within the bore on the opposite side of the seat from the valve element, for engaging and moving the valve member when the pressure acting on the piston means through the first port exceeds the first predetermined limit.

BEST MODE FOR CARRYING OUT THE INVENTION

Figure 1:
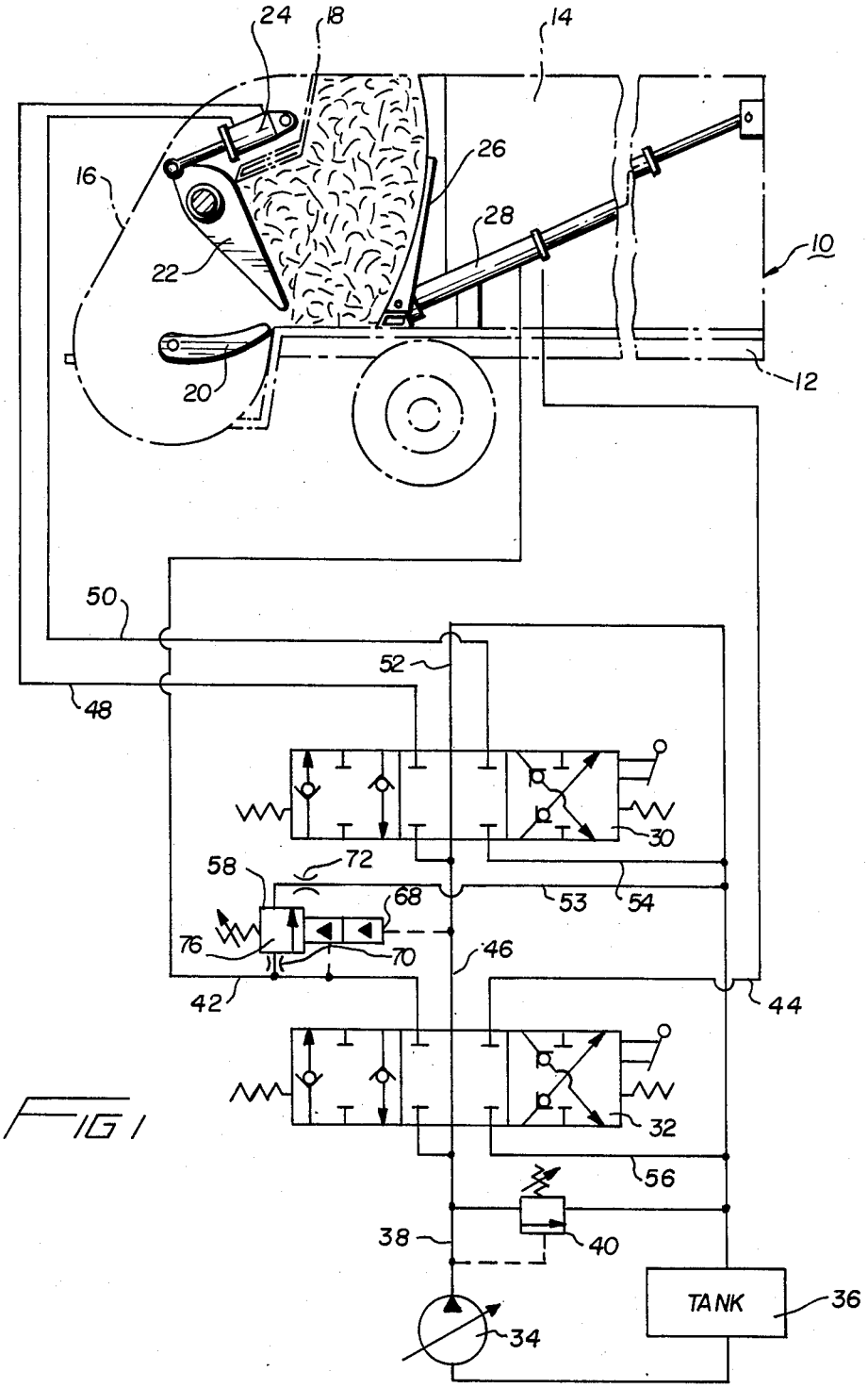
FIG. 1 illustrates schematically an hydraulic system according to the present invention in which a combined sequence-and-relief valve is provided.

The following is a detailed description of the preferred embodiments of the invention, reference being made to the drawings in which like reference numerals identify like elements of structure in each of the several Figures.

In FIG. 1, the rear portion 10 of a typical refuse truck is illustrated schematically and fragmentarily. Hydraulic control systems and valves according to the present invention are well suited for use on such refuse trucks. The truck includes a chassis 12 on which a large refuse storage compartment 14 is positioned. At the rear end of compartment 14, a tail-gate assembly 16 is attached by means of hinges 18. When refuse is to be ejected from compartment 14, tail-gate assembly 16 is raised on hinges 18 by a piston-and-cylinder motor, not illustrated. Within tail-gate assembly 16, a rotating sweep panel 20 is driven counter-clockwise by a suitable motor, not illustrated, in synchronism with a ram or packer panel 22 driven by an hydraulic, double acting piston-and-cylinder motor 24 which is secured at one end to tailgate assembly 16 and at the other end to packer panel 22. Within the storage compartment 14, an ejector panel 26 is positioned by a conventional, double-acting, telescopic piston-and-cylinder motor 28 which is secured between packer panel 26 and the front end of storage compartment 14.

In operation of the structure described thus far, ejector panel 26 is moved all the way to the rear of storage compartment 14 to eject previously collected refuse. Then, tailgate assembly 16 is lowered to its illustrated position and collection of additional refuse may begin. The refuse is swept from the lower portion of tailgate assembly 16 upward to a position where packer panel 22 engages it and forces it into storage compartment 14 and into contact with ejector panel 26. As the packing of the refuse continues, a point eventually is reached in which motor 24 has fully compacted the refuse and is no longer able to move packer panel 22 unless the pressure in motor 28 is relieved to allow ejector panel 26 to move forwardly within storage compartment 14. The hydraulic controls which permit such movement of ejector panel 26 and control actuation of packer motor 24 are shown in lower half of FIG. 1.

A packer control valve 30 and an ejector control valve 32 are illustrated in the conventional manner, each being a manually controlled, spring centered, open center, three position valve in this example. A pump 34 draws hydraulic fluid from a suitable source or tank 36 and passes the fluid through a discharge conduit 38, through the open centers of valves 30,32 and back to tank 36. A system relief valve 40 is connected to conduit 38 between pump 34 and valve 32 to relieve pump overpressure should the discharge pressure of the pump exceed, say, 2,000 psi.

A pair of conduits 42,44 connect the cylinder ports of valve 32 to the ejector motor 28. A conduit 46 extends from the open center of valve 32 to the open center of valve 30. A pair of conduits 48,50 connect the cylinder ports of valve 30 to packer cylinder 24. A conduit 52 directs fluid from the open center of valve 30 back to tank 36. A pair of conduits 54,56 connect the discharge ports of control valves 30,32 to tank 36. A sequence-and-relief valve 58 according to the present invention is connected among conduits 42/44, 46 and tank 36 to relieve the pressure in hydraulic motor 28 as necessary. The notation "42/44" means that valve 58 may be connected to either conduit, depending on which one moves the ejector panel to the rear.

Figure 2:
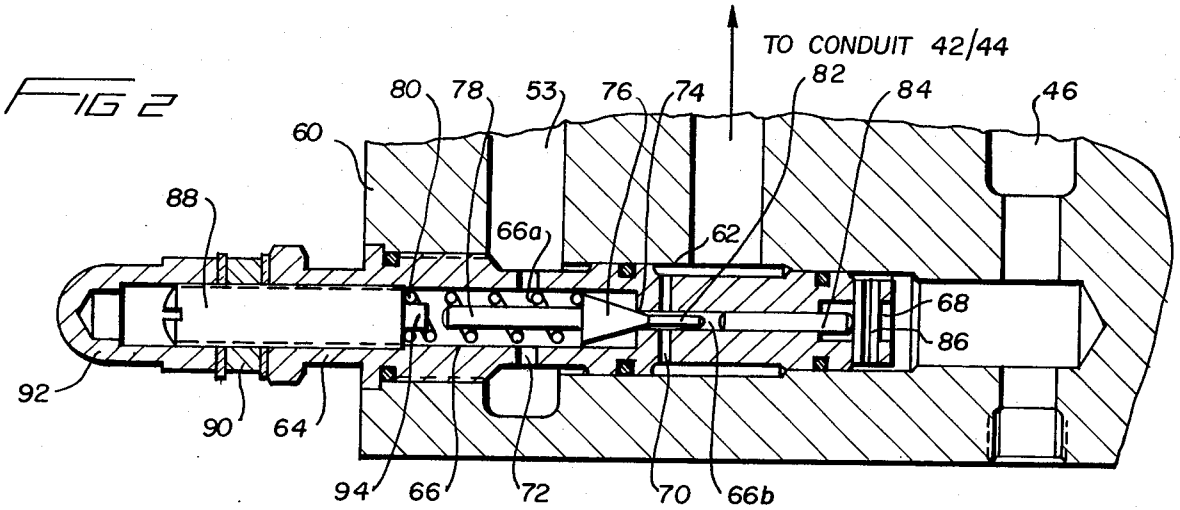
FIG. 2 shows a section view through a combined sequence-and-relief valve of the type shown schematically in FIG. 1.

FIG. 2 illustrates the details of such a sequence-and-relief valve 58. A conventional housing 60 for control valves 30 and 32 is provided with a bore 62 opening to the exterior of the housing. A tubular valve cartridge 64 is threaded into bore 62. Within cartridge 64, a stepped bore 66 includes a large bore section **66*a* and a small bore section 66*b*. A first port 68 opens from small bore section 66*b* to conduit 46; a second port 70 opens from small bore 66*b* to one of conduits 42/44; and a third port 72 opens from large bore section 66*a* to a conduit 53 leading to tank 36**. Between these ports, appropriate seals are provided such as the illustrated O-rings.

A circular valve seat 74 defines the right hand end of large bore section **66*a* at a location between ports 70 and 72. A conical, sequence-and-relief poppet valve member 76 is positioned to slide within large bore section 66*a* and to engage valve seat 74. Valve member 76 includes a leftwardly projecting axial extension 78 which extends along the center of large bore section 66*a* within a coil spring 80 which biases valve member 76 into contact with valve seat 74. A rightwardly projecting axial extension 82 of valve member 76 projects into small bore section 66*b* into position to be contacted by a pin-like piston 84 slidably positioned in small bore section 66*b*. As illustrated, the right end of piston 84 is exposed to the pressure acting at port 68. A stop pin 86** extends across port 68 to prevent piston 84 from sliding out of small bore section 66*b*.

The seating force of spring 80 may be adjusted by means of an adjustment screw 88 threaded into bore 66 at its left end. Once the desired seating force has been achieved, screw 88 can be locked into position by means of a jam-nut 90 and jam-cap 92. Finally, an axially projecting stop 94 on the inner end of screw 88 limits the leftward movement of valve member 76.

In operation of the embodiment illustrated in FIG. 2, the sequence-and-relief valve remains in its illustrated closed position until the pressure acting at either port 68 or port 70 exceeds predetermined limits. If the packer motor 24 encounters sufficient resistance while refuse is packed into compartment 14 and while valve 32 is in its neutral or blocked position, the pressure in conduit 46 leading to valve 30 will reach a level, such as 1,500 psi, sufficient to cause piston 84 to move to the left into contact with axial extension 82, thereby causing valve member 76 to shift to the left and permit flow from one of conduits 42/44, through port 70, through valve seat 74, through port 72 and back to tank 36. On the other hand, should the pressure within ejector motor 28 be forced upward to a predetermined limit such as 1,800 psi as refuse is packed into storage compartment 14, this pressure acts through port 70 against valve member 74 also causing valve member 74 to shift to the left to permit the flow from motor 28 back to tank 36.

So, in response to either a high pump discharge pressure in conduit 46 or a high pressure in motor 28, the valve shown in FIG. 2 will shift to relieve the pressure in motor 28, thereby allowing the ejector panel 26 to shift to the right so that additional refuse may be packed into the container. Since the pump pressure at sensing port 68 is downstream of valve 32, high pump pressure is available for refuse ejection. The cross-sectional area of ports 70,72, the opening through valve seat 74 or all of these may be adjusted as necessary to establish the flow rate back to tank 36 which will maintain adequate pressure for compaction of the refuse even while ejector panel 26 is moving forward. Preferably, though, either port 70 or port 72 is sized to control flow back to tank 36. When either port 70 or port 72 is the flow controlling, smallest restriction, the performance of valve 58 has been estimated to be essentially the same in response to pressure increases in conduit 42/44. But, when port 72 is the controlling restriction, the performance is estimated to be somewhat different than it would be with port 70 as the controlling restriction, in response to pressure increases in conduit 46. When port 72 is the smallest restriction, a back pressure is created in large bore portion 66a when valve member 76 is moved away from seat 74 by pressure acting on piston 84. This back pressure tends to reseat valve member 76, causing a type of compensated flow control for flow from conduit 42/44. This effect is to achieved when port 70 is the smallest restriction, due to the absence of back pressure tending to reseat valve member 76.

Figure 3:
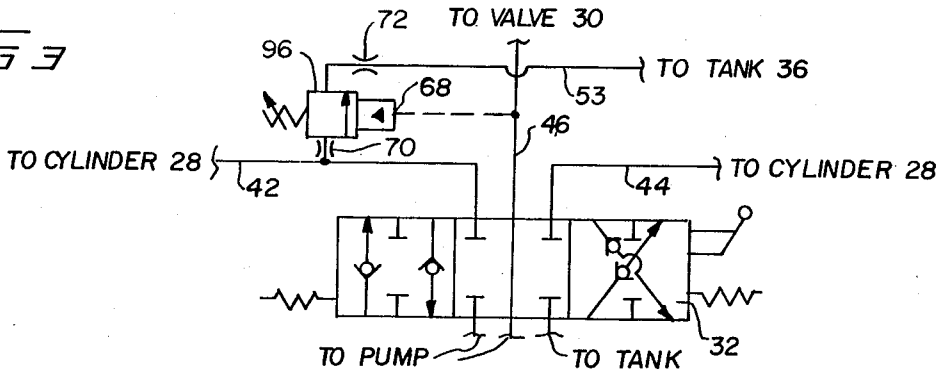
FIG. 3 shows a fragmentary schematic diagram of an hydraulic control system according to the invention which embodies a sequence-only valve.
Figure 4:
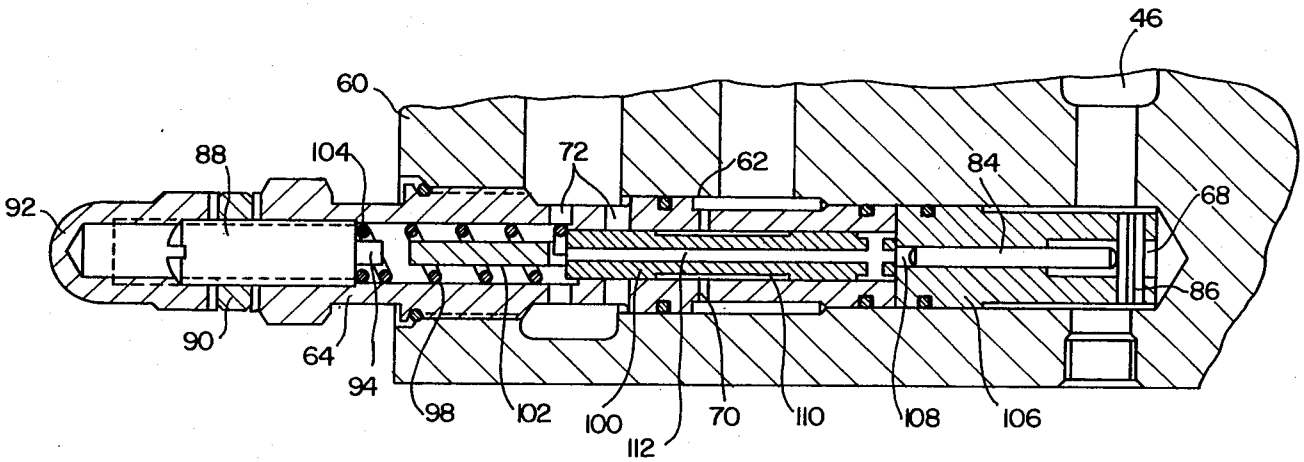
FIG. 4 shows a section view of a sequence-only valve of the type shown schematically in FIG. 3.

FIG. 3 illustrates schematically a portion of the hydraulic control system shown in FIG. 1, in which the sequence-and-relief valve previously described has been replaced by a sequence-only valve 96 connected among conduits 42/44, 46 and tank 36, to relieve the pressure in cylinder 28 when the pump discharge pressure reaches a predetermined limit. As shown in FIG. 4, valve 96 comprises a cartridge 64 similar to that illustrated in FIG. 2, the cartridge having a central bore 98 within which a sequence valve spool 100 is slidably positioned. At the left end of spool 100, as illustrated, an axial extension 102 projects into the interior of a biasing spring 104 which forces the spool to the right into contact with a cartridge extension 106 having a central bore 108 for slidably receiving a pin-like piston 84. A cartridge 64 and a cartridge extension 106 are used in this embodiment so that the central bore 98 may be precisely machined to seal against spool 100 as it slides within the bore. Spool 100 comprises on its outer surface an axially extending portion 110 of reduced diameter which is of sufficient length to interconnect ports 70 and 72 when spool 100 has been moved to the left against the force of spring 104 to allow flow from conduits 42/44 back to tank 36. A central bore 112 within spool 100 provides pressure equalization at either end of the spool.

In operation of the embodiment shown in FIGS. 3 and 4, excessive pump discharge pressure acting in conduit 46 will cause piston 84 to shift to the left into contact with spool 100 which then moves to the left against the action of spring 104 until axially extending portion 110 permits flow from port 70 to port 72 to relieve the pressure in cylinder 28. Flow back to tank may be controlled by sizing ports 70, 72 in the manner previously discussed.

INDUSTRIAL APPLICABILITY

Although the invention has been described with particular reference to the hydraulic controls for a refuse truck, those skilled in the art will appreciate that it is applicable in many situations where plural series control valves are used to control an hydraulic motor.

Having described my invention in sufficient detail to enable those skilled in the art to make and use it, I claim:

1. An hydraulic system comprising:

a source of hydraulic fluid;

a pump connected to said source for delivering a flow of said hydraulic fluid;

a fluid actuated piston-and-cylinder motor;

open center control valve means for directing fluid to and from opposite sides of said piston to cause said piston to translate within said cylinder and move a load;

a first conduit connected from said pump, through the open center of said control valve means and back to said source;

a second conduit connected from a cylinder port of said control valve means to one side of said piston;

a third conduit connected from another cylinder port of said control valve means to the other side of said piston;

a fourth conduit connected from a discharge port of said control valve means to said source; and sequence valve means connected downstream of said control valve means among said first conduit, one of said second and third conduits, and said source, for venting said cylinder on one side of said piston to said source when pressure downstream of said control valve means in said first conduit exceeds a first predetermined limit, said sequence valve means comprising:

a housing having a first bore therein, said first conduit, one of said second and third conduits and said fourth conduit being connected to said first bore;

a tubular valve cartridge positioned within said first bore, said valve cartridge having a second bore and at least one first port leading from said second bore to said first conduit, at least one second port leading from said second bore to said one of said second and third conduits and at least one third port leading from said second bore to said fourth conduit;

a valve member mounted to slide within said second bore, said valve member having an axially extending portion of reduced diameter for hydraulically connecting said at least one second port and said at least one third port when said pressure in said first conduit exceeds said first predetermined limit;

means for biasing said valve member away from a position in which hydraulic communication is established between said at least one second and third ports; and piston means mounted to slide within said second bore for engaging and moving said valve member when the pressure acting through said first port on said piston means exceeds said first predetermined limit, thereby establishing communication between said at least one second and third ports.

2. An hydraulic system according to claim 1, wherein said first bore opens to the exterior of said housing and said valve cartridge is externally threaded to secure said valve cartridge in said first bore.

3. An hydraulic system according to claim 1, further comprising stop means in said second bore for limiting movement of said valve member by said piston means.

4. An hydraulic system comprising:

a source of hydraulic fluid;

a pump connected to said source for delivering a flow of said hydraulic fluid;

a fluid actuated piston-and-cylinder motor;

open center control valve means for directing fluid to and from opposite sides of said piston to cause said piston to translate within said cylinder and move a load;

a first conduit connected from said pump, through the open center of said control valve means and back to said source;

a second conduit connected from a cylinder port of said control valve means to one side of said piston;

a third conduit connected from another cylinder port of said control valve means to the other side of said piston;

a fourth conduit connected from a discharge port of said control valve means to said source; and sequence-and-relief valve means connected downstream of said control valve means among said first conduit, one of said second and third conduits and said source, for venting said cylinder on one side of said piston to said source when the pressure in said one side or the pressure downstream of said control valve means in said first conduit exceeds a predetermined limit, said sequence and release valve means comprising:

a housing have a first bore therein, said first conduit, one of said second and third conduits and said fourth conduit being connected to said first bore;

a tubular valve cartridge positioned within said first bore, said valve cartridge having a second bore and at least one first port leading from said second bore to said first conduit, at least one second port leading from said second bore to said one of said second and third conduits and at least one third port leading from said second bore to said fourth conduit;

a valve seat in said second bore between said second and third ports;

a valve member mounted to slide within said second bore;

means for biasing said valve member into contact with said valve seat to close hydraulic communication between said second and third ports until the pressure on said one side of said piston exceeds a first predetermined limit and acts through said second port to cause said valve member to move away from said seat; and piston means mounted to slide within said bore on the opposite side of said seat from said valve member, for engaging and moving said valve member when the pressure acting on said piston means through said first port exceeds a second predetermined limit.

5. An hydraulic system according to claim 4, wherein said first bore opens to the exterior of said housing and said valve cartridge is externally threaded to secure said sequence-and-relief valve means in said first bore.

6. An hydraulic system according to claim 4, further comprising stop means in said second bore for limiting movement of said valve member by said piston means.

7. An hydraulic system according to claim 4, wherein said third port is smaller than said second port so that back pressure in said second bore tends to reseat said valve member.

8. An hydraulic system having first and second distinct sources of pressure to be monitored, including a pump for driving at least one motor, a control valve for controlling flow from the pump to the motor, and a tank, the improvement comprising a sequence-and-relief valve comprising:

a housing having a first bore therein;

a tubular valve cartridge positioned within said first bore, said valve cartridge having a second bore and at least first, second and third ports adapted for connecting to the first and second distinct sources and the tank, respectively, of a hydraulic circuit;

a valve seat in said second bore between said second and third ports;

a valve member mounted to the slide within said second bore;

means for biasing said valve member into contact with said valve seat to close hydraulic communication between said second and third ports until the pressure from the second distinct source exceeds a first predetermined limit and acts through said second port to cause said valve member to move away from said seat to relieve the pressure of the second distinct source to the tank, said pressure of the second distinct source effecting hydraulic communication between the second and third ports and to the tank at any given position of the control valve; and piston means mounted to slide within said bore on the opposite side of said seat from said valve member for engaging and moving said valve member away from the seat to relieve the pressure of the second distinct source to the tank when the pressure from the first distinct source acting on said piston means through said first port exceeds a second predetermined limit.

9. An hydraulic system according to claim 8, wherein the control valve controls flow fromthe pump to the second distinct source.

10. An hydraulic system according to claim 9, further comprising a second motor and a second control valve, said second control valve controlling flow from the pump to the second motor.

11. An hydraulic system according to claim 10, wherein said first distinct source of pressure comprises the pressure of the pump.

12. An hydraulic system according to claim 11, said pressure of the first distinct source effecting hydraulic communication between the second and third ports and to the tank at any given position of the second control valve.

13. An hydraulic system according to claim 10, wherein said first distinct source of pressure comprises the pressure of the second motor.

14. An hydraulic system according to claim 13, said pressure of the first distinct source effecting hydraulic communication between the second and third ports and to the tank at any given position of the second control valve.

* * * * *